United States Patent [19]

Combes et al.

[11] 4,449,851

[45] May 22, 1984

[54] ENERGY-EFFICIENT AUTOMATIC SLUICE GATE FOR SUSTAINING A FLUID LEVEL

[75] Inventors: Gilles Combes, Grenoble; Germain Delage, Saint-Ismier, both of France

[73] Assignee: Alsthom-Atlantique, Paris, France

[21] Appl. No.: 449,292

[22] Filed: Dec. 13, 1982

[30] Foreign Application Priority Data

Jan. 12, 1982 [FR] France ..... 82 00344

[51] Int. Cl.[3] ..... E02B 7/42

[52] U.S. Cl. ..... 405/93; 405/96; 405/100

[58] Field of Search ..... 405/92, 93, 94, 96, 405/97, 100, 101, 102

[56] References Cited

U.S. PATENT DOCUMENTS 2,984,986 5/1961 Hill ..... 405/93

3,221,504 12/1965 Turner ..... 405/96 X

FOREIGN PATENT DOCUMENTS 1080677 12/1954 France .

2071299 9/1971 France .

*Primary Examiner*—David H. Corbin

*Attorney, Agent, or Firm*—Sughrue, Mion, Zinn, Macpeak, and Seas

[57] ABSTRACT

An energy-efficient automatic sluice gate for sustaining a fluid level, separating an upstream pool from a downstream pool in an irrigation system and enabling the level of water in one of the pools to be kept constant at a settable value. A sluice gate separates an upstream pool (1) from a downstream pool (2) and enables the level of one of the pools to be kept constant at a settable value, said gate comprising a baffle (3) movable about a horizontal rotational shaft (4) whereby the rotation of the baffle about its shaft determines the flow of water downstream, said baffle constituting a segment of a cylinder having the said rotational shaft as its axis, and further comprising a box member (7A) and a second box member (7B), both moving with the baffle and dipping respectively in the upstream pool and in the downstream pool, means (9, 13, 15) for at least partially filling the box members, means (20) for keeping constant the level in the first or the second box member according to whether the level in the upstream pool or in the downstream pool is to be kept constant and means (50) of setting said constant level value.

7 Claims, 4 Drawing Figures

ENERGY-EFFICIENT AUTOMATIC SLUICE GATE FOR SUSTAINING A FLUID LEVEL

The present invention concerns a sluice gate separating an upstream pool supplied with water and a water-supplying downstream pool, said gate enabling the water level in one of the pools to be automatically maintained at an adjustable set point.

BACKGROUND OF THE INVENTION

Alsthom's French Pat. No. 2,071,299 describes valves satisfying the same requirement, comprising a moving baffle which tilts about a horizontal shaft and is actuated by an adjustable-ballast float.

Such valves have the following disadvantages: they make it necessary to select the operating mode (regulation either of the upstream level or the downstream level) on a permanent basis; and require that the level to be kept constant also be set permanently, said level setting being impossible or very difficult to modify.

Preferred embodiments of the present invention provide an automatic level sustaining valve or sluice gate enabling the changeover from regulation of the upstream level to regulation of the downstream level to be easily accomplished and also enabling the set point to be adjusted, both either manually or by remote control by means of a low-level signal transmitted, for example, via a telephone line.

SUMMARY OF THE INVENTION

The present invention provides a sluice gate for automatically sustaining a level, using a small amount of energy, wherein said gate controls the flow of water from an upstream pool to a downstream pool and comprises:

a closing baffle carried by a framework movable about a horizontal rotating shaft located downstream from the baffle such that rotation of said framework about said shaft controls the section of water flowing from upstream to downstream, said baffle constituting one segment of a revolving cylinder with the said rotating shaft as its axis;

and a box member, which carried by the above framework, dips into the pool, the level of which must be maintained so that the angular position of the framework is determined by the water level therein, said box member having an opening at the bottom for the passage of water and an opening at the top for the passage of air to enable the amount of water in the box member to be varied;

said gate further comprising an upstream box member and a downstream box member, both carried by the framework, located opposite one another across from said shaft such as to be held partially immersed respectively in the upstream and downstream pools, the pools being separated by the abovementioned baffle and both box members having openings in their tops and bottoms as described;

and pressure regulating means communicating with said openings via switching valves such that they may be caused to operate alternately in an upstream regulation mode and a downstream regulation mode, said regulating means controlling the water level in a "regulating" box member, which would be the upstream box member in the upstream regulation mode and the downstream box member in the downstream regulation mode, so as to automatically maintain the water level in a "regulated" pool or basin, being the one in which the box member dips, said switching valves allowing water and air to flow through the openings in the other box member to balance the water levels obtaining in said non-regulating box member and in the unregulated pool.

Depending on the circumstances, one or more of the following features may be preferably adopted:

Each of said box members is given an approximately uniform horizontal cross section over its entire useful height and the center of gravity of the assembly attached to the framework is located approximately at the height of said rotational shaft such that the rotational torque applied to the framework is determined exclusively by the difference between water levels in the regulating box member and the regulated pool.

Control means are provided, comprising a limited-flow compressed gas supply fitted with tubing whose open end is immersed in the upstream pool at a height controlled by said regulating means, a switching valve to connect said supply with the upper opening in the regulating box member and a switching means to connect the lower opening of the downstream box member with the upstream or downstream pool, according to the box member's regulating or non-regulating status, such that the lower opening of the upstream box member issues into the upstream pool even when it is non-regulating.

Said regulating means are provided with an outlet spout of adjustable height, some means of filling said outlet spout with a limited flow and means for connecting the lower opening of the regulating box member with said filling means, the upper opening of said box member being vented to the atmosphere.

The spout-filling means comprise tubing issuing into the upstream pool, the spout itself pouring into the downstream pool.

The spout-filling means further comprise an auxiliary pool or basin supplied with clean water.

The lower opening of the non-regulating box member communicates with the unregulated pool via a circuit equivalent in terms of pressure losses to a cross-sectional area from 2 to 0.02% of that of the free surface of the water in the box member, the upper opening of said box member allowing the air to flow virtually unhindered between the inside of said box member and the air, such as to provide a partial, temporary servo control of the level in the unregulated pool, in particular during changeovers between upstream and downstream regulation.

BRIEF DESCRIPTION OF THE DRAWINGS

Embodiments of the invention are described by way of example with reference to the accompanying drawings in which.

MORE DETAILED DESCRIPTION

Figure 1:
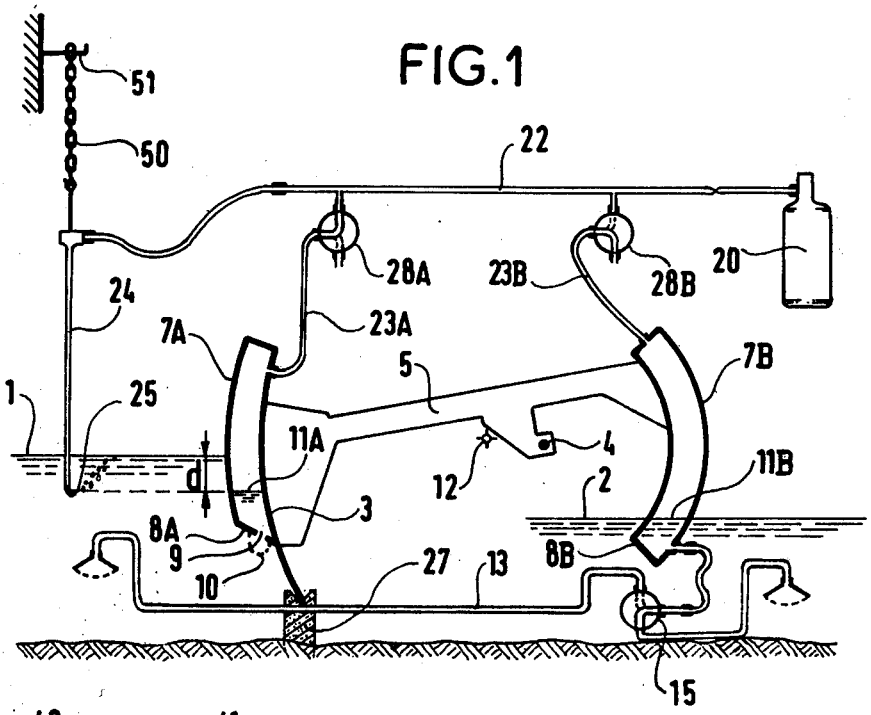
FIG. 1 is a diagrammatic cross sectional view of a sluice gate in accordance with the present invention.

Referring to FIG. 1, reference 1 depicts the level in an upstream pool and reference 2 the level in a downstream pool constituting two successive reaches of an irrigation ditch.

The automatic sluice gate shown is designed to maintain the level upstream or downstream at a constant value. It comprises a baffle 3, movable about a rotating shaft 4. The baffle is connected to the shaft by means of a framework 5 and it controls the size of the water passage over a concrete ground sill 27.

An upstream box member 7A, moving with the baffle, is partly immersed in the upstream pool and a downstream box member 7B, moving with the framework, is partly immersed in the downstream pool.

The lower end wall 8A of box member 7A has a "lower" opening 9 enabling partial filling of the box member. The opening is protected by a screen 10, preventing the ingress of refuse into the box member.

Partial filling of the downstream box member 7B is obtained by means of a switching valve 15 which connects said member either with the upstream pool, via tubing 13, or with the downstream pool.

Both box members are connected to a limited-flow compressed air source 20 via tubings 22, 23A and 23B as well as via switching valves 28A and 28B which establish a connection between tubing 22 and either the upstream or the downstream box member, leaving the unconnected box member vented to the atmosphere. Valves 28A, 28B and 15 are actuated at the same time. Gas escape in bubbles via tubing 24, which communicates with tubing 22 and the end 25 of which is immersed in the upstream pool to a depth d below the level 1 of said pool.

In order to regulate the level upstream (the case shown in the figure), box member 7A, which becomes the regulating box member, is made to communicate with the gas supply; the other box member 7B remains passive and serves as a damper, being vented to the atmosphere and connected to the downstream pool via switching valve 15. In order to regulate the level downstream, box member 7B serves as the regulating member and is made to communicate with the gas supply as well as, via component 15, with the upstream pool. Box member 7A is vented to the atmosphere and becomes the damping member.

The system is so assembled that the pressure in the tubing and inside the box member serving as regulator is constant and equal to d expressed in terms of meters of water. The water level inside the regulating box member is thus always at the height of the bottom end 25 of tubing 24, regardless of the level obtaining in the upstream pool.

The upstream and downstream walls of the box members, as well as the baffle, are sections of surfaces revolving about the rotating shaft such that hydrostatic pressures against the walls cannot induce a rotational torque. Only the lower end walls 8A and 8B of the box members can apply a pressure on the movable framework, said pressure being proportional to the difference in water levels inside and outside the relevant box member.

The sluice gate framework is so designed as to have the center of gravity 12 of the moving assembly be located upstream from the rotational axis 4, near the horizontal plane intersecting the rotational axis, when the gate assembly is in an intermediate position.

The mechanical torque stemming from the weight of said moving assembly is balanced either by the hydrostatic pressure on box member 7A when said upstream box member serves as the regulator, or by the greater weight of water in box member 7B in the case when said downstream box member serves as regulator, said pressures and forces being proportional to the difference between the level upstream and the level in box member 7A in the case of upstream regulation, and proportional to the difference between the level downstream and the level in box member 7B in the case of downstream regulation. It should be appreciated that the level in the nonregulating box member is the same as that in the pool in which it is partly immersed, thanks to the simultaneous operation of valves 28A, 28B and 15. A difference in these levels occurs only during quick transitions, because of the limitation on the rate at which water can flow into or out of the box members under a given pressure. The inventors have found that this flowrate limitation improves the stability of upstream pool-sluice gate-downstream pool system operation where said pools are canal reaches, thus improving regulation precision. Consequently, in cases where the water flows through a simple opening in a sheet metal part, the cross sectional area of said opening should be given suitable dimensions in relation to the free surface area of the water in the box member. Said cross sectional area will depend on the nature of the upstream and downstream reaches of the irrigation ditch, but it will generally fall within the previously-mentioned limits. In cases where water is made to circulate through a pipe system, the cross sectional area of an opening which would be equivalent to said pipe system in terms of pressure losses should be considered.

The constancy of the position of the level in the box member selected to be the regulating member imparts a constant level to the corresponding pool. With reference to the example of upstream level regulation, if the water level in the upstream pool tends to rise, the water level 11A in box member 7A remaining stable, the hydrostatic pressure against the box member will increase and the sluice gate will fully open the passageway between the baffle and ground still 27 because, due to the location of the gate's center of gravity, the mechanical torque applied to the gate by its own weight and by the water pressure is nearly constant at all angular positions.

The gate rotates in the reverse direction in the case of a lowering of the level in the upstream pool. Quick, accurate regulation is thus obtained.

Regulation of the level in either pool can be obtained simply by raising or lowering tubing 24. Raising the tubing increases the value of the level set point and lowering the tubing decreases the value of the level set point. Tubing 24 can be raised or lowered by hand, or at a distance using a remote controlled motor.

For example, as shown in FIG. 1, tubing 24 may be suspended from a fixed hook 51 by means of a chain 50 and its height adjusted by hooking different links of the chain (manual control). Alternatively, as per FIG. 2, tubing 24 may be suspended from a cable 42 wound around a winch 40 driven by a remotely controlled motor 41 powered from a self-contained energy source such as a solar battery (remote control).

Pressurized gas may be supplied by a compressed air cylinder which must be replaced from time to time, or by a compressor driven by a self-contained power supply, such as a solar battery, or by the difference in water pressure between the upstream and downstream pools.

Similarly, switching valves 15, 28A and 28B may be remotely controlled, thus affording a choice of the pool whose level is to be kept constant. Said valves, serving to control very small air flows, are small and are susceptible to being actuated by low-powered control means of generally less than 10 W.

Figure 2:
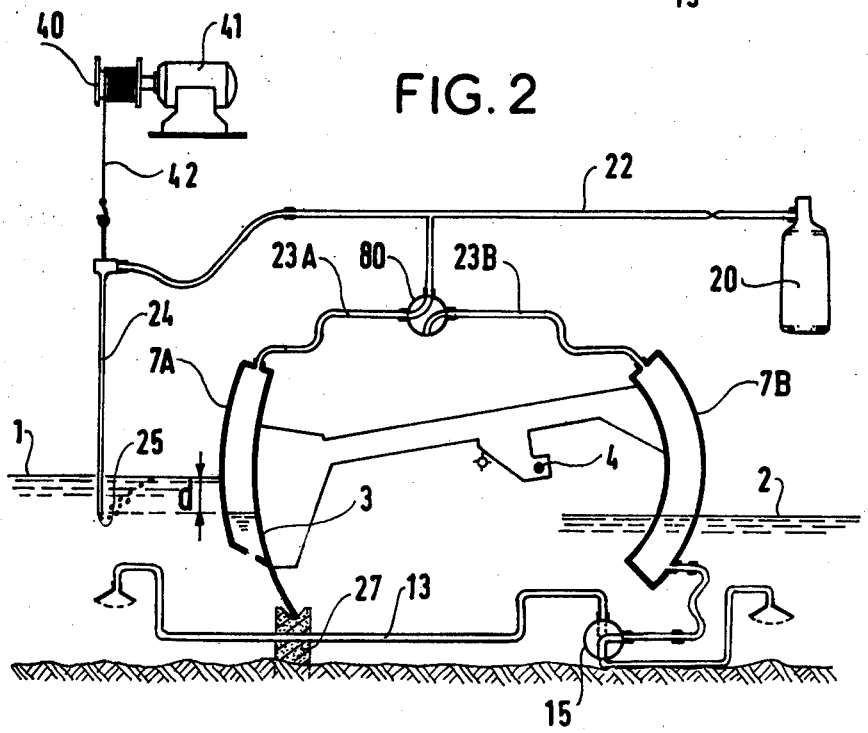
FIG. 2 is a diagrammatic cross sectional view of another sluice gate in accordance with the invention.

FIG. 2 depicts an alternative construction of the device shown in FIG. 1, having a simpler tubing and valve system.

Features common to both figures have been given the same reference numbers.

Valves 28A and 28B have been replaced by a single valve 80, which is actuated simultaneously with switching valve 15.

Changeover from constant level control of the upstream pool (the case of FIG. 2) to constant level control of the downstream pool is obtained by simultaneously rotating valves 80 and 15 one quarter turn.

Figure 3:
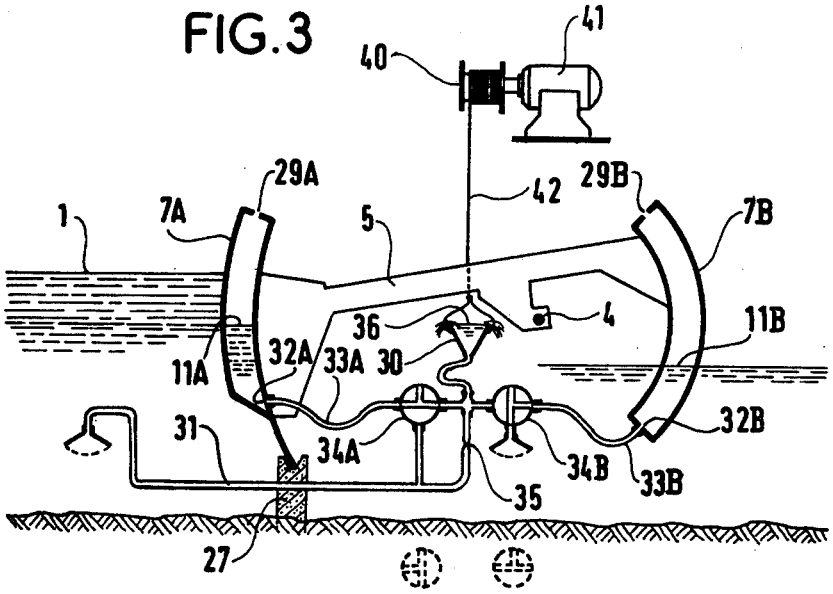
FIG. 3 is a diagrammatic cross sectional view of a third embodiment of the present invention, having an outlet spout.

FIG. 3 depicts an alternative construction of an automatic sluice gate for keeping constant the water level in the upstream or the downstream pool. Features common to FIGS. 1 and 3 bear the same reference numbers in both figures.

Box members 7A and 7B are provided with upper openings 29A and 29B, but their bottoms 8A and 8B are closed.

In this arrangement, levels 11A, 11B in the box members are kept constant thanks to an outlet spout 30, which is supplied with water from the upstream pool via tubing 31, empties into the downstream pool and links up with bottom end apertures 32A and 32B in the box members via tubes 33A and 33B. Water therefore circulates between the upstream pool and the downstream pool via tubing 31 and pour spout 30.

A pressure drop diaphragm 35 is installed in tubing 31 such that level 11A remains approximately equal to the level 36 of pour spout 30.

Switching valves 34A and 34B connect either the upstream box member or the downstream box member with tubing 31 and spout 30, leaving the unconnected member directly connected with the pool in which it is partly immersed.

With the level inside one of the box members constant, level 1 in the corresponding pool will also be constant.

Regulation of the pool level is obtained by raising or lowering pour spout 30, as described concerning tubing 24 of FIG. 1, for example.

As in the preceding cases, valves 34A and 34B may be remotely controlled to select the pool to be regulated.

Figure 4:
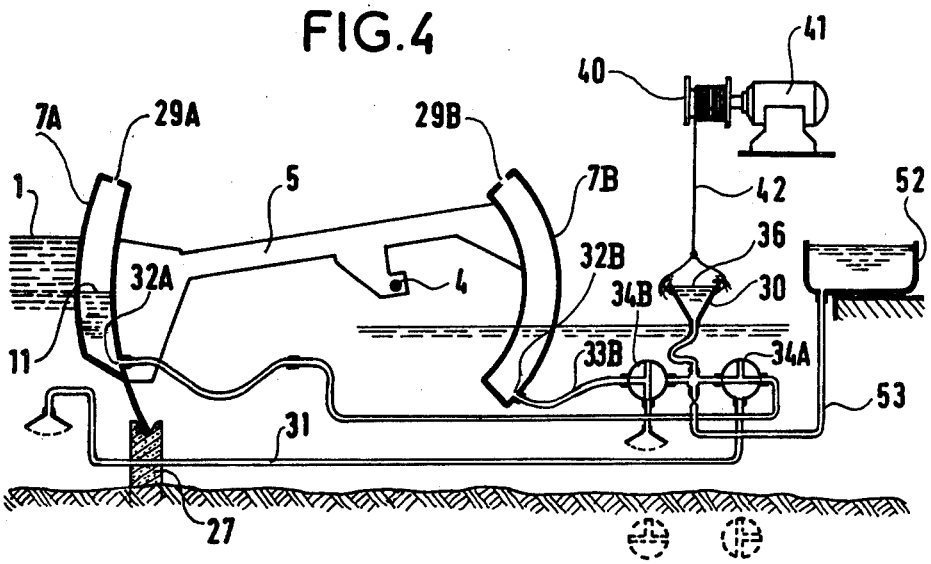
FIG. 4 is a diagrammatic cross sectional view of a fourth embodiment of the present invention wherein water is supplied to the box members from an auxiliary vessel.

FIG. 4 depicts a sluice gate according to the invention for keeping constant the water level in a pool, which differs from the gate of FIG. 3 in that the box members are no longer fed from the upstream pool, but rather from an external pool or basin 52, via a tubing 53. The remainder of the device is the same as per FIGS. 1, 2 and 3. The set point remote control system is schematically represented by a winch and its motor.

This alternative embodiment has the advantage of enabling the system to be partly supplied with water from a source other than the upstream pool, said other source possibly being cleaner and thus avoiding or lessening the chances of solid matter clogging the pipes or valves.

We claim:

1. An energy-efficient automatic sluice gate for sustaining a fluid level, wherein said gate controls the flow of water from an upstream pool to a downstream pool and comprising:

a closing baffle carried by a framework movable about a horizontal rotating shaft located downstream from the baffle such that rotation of said framework about said shaft controls a section of water flowing from upstream to downstream, said baffle constituting one segment of a revolving cylinder with said rotating shaft as its axis;

and at least one box member carried by said framework, which dips into the pool, the level of which must be maintained so that the angular position of said framework is determined by the water level therein, said at least one box member having an opening at the bottom for the passage of water and an opening at the top for the passage of air to enable the amount of water in the box member to be varied;

said at least one box member comprising an upstream box member and a downstream box member, both carried by the framework, located opposite one another across from said shaft such as to be held partially immersed respectively in the upstream and downstream pools, the pools being separated by the above-mentioned baffle with both box members having openings in their tops and bottoms;

and pressure regulating means operatively communicating with said openings via switching valves such that they may be caused to operate alternately in an upstream regulation mode and a downstream regulation mode, said regulation means controlling the water level in a regulating box member, constituting said upstream box member in the upstream regulation mode and said downstream box member in the downstream regulation mode, so as to automatically maintain the water level in a regulated pool or basin, being the one in which the regulating box member dips, with said switching valves allowing water and air to flow through the openings in the other, non-regulating box member to balance the water levels obtaining in said non-regulating box member and in the unregulated pool.

2. A sluice gate according to claim 1 wherein each of said box members is given an approximately uniform horizontal cross section over its entire useful height and wherein the center of gravity of the assembly attached to the framework is located approximately at the height of said rotational shaft such that the rotational torque applied to the framework is determined exclusively by the difference between the water levels in the regulating box member and the regulated pool.

3. A sluice gate according to claim 1, wherein said regulating means comprise control means comprising a limited-flow compressed gas supply fitted with tubing whose open end is immersed in the upstream pool at a settable height, a switching valve to connect said supply with the upper opening of the regulating box member and a switching valve to connect the lower opening of the downstream box member with the upstream pool or the downstream pool, according to whether the latter box member is regulating or non-regulating, such that the lower opening of the upstream box member issues into the upstream pool even when it is non-regulating.

4. A sluice gate according to claim 1, wherein said control means comprise an outlet spout of adjustable height, means for filling said limited-flow outlet spout and means for connecting the lower opening of the regulating box member with said filling means with the upper opening of said box members being vented to the atmosphere.

5. A sluice gate according to claim 4, wherein the spout-filling means comprise tubing opening into the upstream pool with the spout itself pouring into the downstream pool.

6. A sluice gate according to claim 4, wherein the spout-filling means comprise an auxiliary pool or basin supplied with clean water.

7. A sluice gate according to claim 1, wherein the lower opening of the non-regulating box member communicates with the unregulated pool via a circuit equivalent in terms of pressure losses to a cross-sectional area from 2 to 0.02% of that of the free surface of the water in said box member, and whereby the upper opening of said box member allows the air to flow virtually unhindered between the inside of said box member and the outside air, such as to provide a partial, temporary servo control of the level in the unregulated pool, particularly in the course of changeovers between upstream and downstream regulation.

* * * * *